United States Patent [19]

Willis

[11] 3,946,926

[45] Mar. 30, 1976

[54] AUTOMATIC FASTENER EMPLACEMENT MECHANISM

[76] Inventor: Clyde P. Willis, P.O. Box 335, Conover, N.C. 28613

[22] Filed: Aug. 26, 1974

[21] Appl. No.: 500,644

[52] U.S. Cl. ..... 227/112; 227/116

[51] Int. Cl.[2] ..... B25C 1/04

[58] Field of Search ..... 227/112, 113, 114, 115, 227/116

[56] References Cited

UNITED STATES PATENTS

| | | | |
|---|---|---|---|
| 1,263,794 | 4/1918 | Neff | 227/112 |
| 1,703,458 | 2/1929 | Ruff | 227/112 |
| 1,980,967 | 11/1934 | DeMooy | 227/112 |

*Primary Examiner*—Granville Y. Custer, Jr.

[57] ABSTRACT

Fasteners, such as nails, tacks, screws, rivets or the like are continuously fed from a vibratory, bowl feed-type supply hopper into a vibrating delivery chute or slide from whence they are removed, one at a time, by an escapement mechanism and delivered into one end of a feed conduit that is connected at the other end to a fastener driving device. An air supply is connected to the conduit downstream from the outlet of the escapement mechanism thereby inducing a negative pressure which pulls the fasteners from the escapement mechanism and delivers them headfirst into the conduit and on to the receiving chamber of a fastener driving device. The fasteners are delivered into the receiving chamber headfirst in a rearward direction into engagement with the front end of the drive piston.

Some type of aligning means, such as a magnet or a concave indention in the front end of the drive piston or plunger axially aligns the shaft of the fastener with the barrel of the device, as the fastener is moved forwardly a prescribed distance, a microswitch deactivates the air supply in the conduit to prevent misfiring. Return of the drive piston returns the microswitch to its second position which activates the escapement mechanism to feed the succeeding fastener.

The escapement mechanism includes a sliding plate for picking off the fasteners one at a time from the delivery slide at a first position and moving them over to a second position in communication with the outlet of the escapement mechanism. A groove in the slide insures a negative pressure within the escapement mechanism at all times while the air supply is activated to insure proper feeding of the fasteners. Also the delivery slide itself is vibrated by connecting it either directly or indirectly to the pulsating motor of the vibratory type hopper to insure movement of the tacks along the delivery slide.

2 Claims, 6 Drawing Figures

AUTOMATIC FASTENER EMPLACEMENT MECHANISM

BACKGROUND OF THE INVENTION

In recent years, automatic tack hammers which receive tacks from a hopper and drive them at high speeds have become known. Areas in which such devices have not developed wide acceptance, however, is in the field of tacking decorative nails into upholstered furniture and screw driving devices. Such decorative nails are generally round-headed, which create problems both in the feeding control, and also in the alignment of the nail once it is in the chamber of the automatic hammer. For examples of automatic tack hammers and feeders therefor, attention is directed to U.S. Pat. Nos. 2,994,880, 3,283,985, and 3,305,155.

One of the problem areas resides in the escape mechanism which removes fasteners one at a time from a delivery slide and drops them into a pneumatic conduit for delivery individually to the hammer. At the outlet of the escape mechanism, it is known that the fasteners may be dropped by means of gravity into the conduit. Since the initial movement of the fastener responsive to the gravity is relatively slow, this considerably slows down the operation of the mechanism. If the mechanism is attempted to be operated too fast, the escape mechanism will return to a closed position and again engage the fastener head before it has had a chance to drop through the outlet opening In order to combat this problem, previously known devices have introduced a jet of air upstream from the discharge outlet of the escape mechanism to force the fastener out of the escape mechanism fastener, however this also presents a problem, previously unsolved, in that when a jet of air is introduced upstream from the escape mechanism outlet, some of the air blows back through the escape mechanism into the delivery slide which may cause misfeeding of the fasteners, and again slows down the feeding procedure.

A further problem that must be considered is that the tacks must be fed head first, because otherwise the point of the tack may snag in the wall of the flexible conduit and jam the apparatus. Since the fastener is delivered headfirst, it must be returned to the point first position in the drive mechanism.

It is apparent that the shank of the fastener must be coaxially aligned with the longitudinal axis of the receiving chamber. Otherwise, the drive piston will urge the fastener into the workpiece at an angle, causing bending of the nails or screws or improper fastening. A previously known solution for this has been the use of resilient "dogs" on the side of a barrel which engage and grip the head of the fastener and maintain it in proper alignment, however such dogs protrude outwardly from the barrel and prevent access of the gun or hammer to places where access is necessary.

Since air is being used to feed fasteners into the hammer, the fasteners may be inadvertently discharged through the front end of the barrel during forward movement of the drive piston unless the air pressure can be selectively deactivated during the step. Also, the air that delivers the fastener into the receiving chamber must be released, and if vented properly can be used to advantage.

SUMMARY OF THE PRESENT INVENTION

In the apparatus according to the present invention, however, various solutions to the aforesaid problems have been introduced which therefore make the apparatus a novel and unique machine whereby decorative nails, screws with round heads, and even rivets may be automatically dispensed at rapid feeds never before realized. First of all in the escape mechanism, the gravity drop or blowdown jet of air has been replaced by an air stream for conveying the fasteners which is introduced downstream from the discharge outlet of the escape mechanism. Therefore, a negative pressure is induced at the outlet of the escape mechanism which is effective to assist removal of the fastener from the outlet, and which does not include the attendant blowback problems. To the contrary, a slot is provided in a selector slide of the escape mechanism through which the negative air pressure communicates with the delivery slide, to insure that the fasteners in the slide are always urged downwardly toward the escape mechanism, rather than being blown back in the opposite direction.

The delivery slide which connects the supply hopper with the escape mechanism is vibrated by means of a unique arrangement whereby the slide is secured or attached to the body of the vibrating type hooper and picks up the vibrations therefrom to properly insure movement of the fasteners down the slide.

The fasteners are fed head first from the escape mechanism through the conduit to the driving mechanism, thereby preventing snags in the feeding process. As the nail enters the receiving chamber of the hammer, it is moved rearwardly by air pressure into engagement with the front end of the drive piston. The air from the conduit assists in properly feeding the fastener and where nails or tacks are being fed, a magnet or concave area in the front end of the drive piston insures that the proper axial alignment of the shaft is retained. The magnet or concave area eliminates any need for aligning dogs, o-rings or the like as will be explained hereinafter. In the case of screws, the air pressure and screwdriver blade insure proper axial alignment.

One or more vent holes are provided through the wall of the receiving chamber immediately adjacent the underside of the fastener head as it rests against the front end of the drive piston. The vent holes allow the air pressure from the conduit to bleed off slowly the atmosphere, although at the same time facilitating the centering and aligning procedure.

As the fastener is moved forwardly, by the drive piston, and as the point of the fastener moves past the inlet from the conduit, so that the fastener cannot inadvertently fall back into the conduit, the air supply is cut off by a microswitch, so that inadvertent discharge of the nail or screw is prevented.

It is therefore an object of the present invention to provide an improved, automatic, fastener driving mechanism and an improved feeding device therefor.

It is further an object of this invention to provide an improved escapement mechanism in a feed system for an automatic fastener driving mechanism in which the air stream which conveys the fasteners to the drive mechanism creates a negative pressure at the outlet of the escape mechanism to both aid the discharge of fasteners from the escapement mechanism and to facilitate movement of fasteners into the escapement mechanism.

It is yet another object of the present invention to provide a pneumatic tack hammer with an improved receiving chamber in which fasteners received therein are fed rearwardly into engagement with and maintained in engagement with the front end of the drive piston.

It is still a further object of the present invention to provide a tool of the type described wherein the drive piston includes an aligning means in the front end thereof to align nail or tack shanks, thus eliminating "dogs", springs, o-rings, and the like.

Other objects and a fuller understanding of the present invention will become apparent from a reading of the detailed description of the preferred embodiment in connection with the accompanying drawings, in which.

Figure 1:
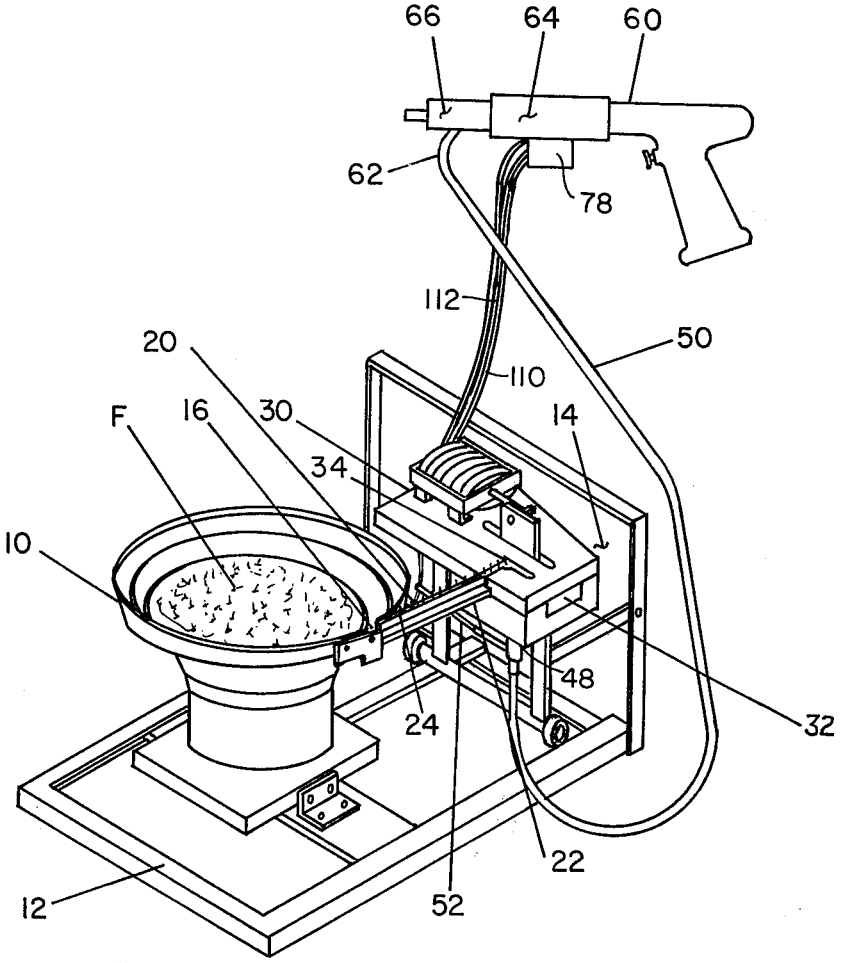
FIG. 1 is a perspective view of the automatic fastener emplacement mechanism of the present invention.
Figure 2:
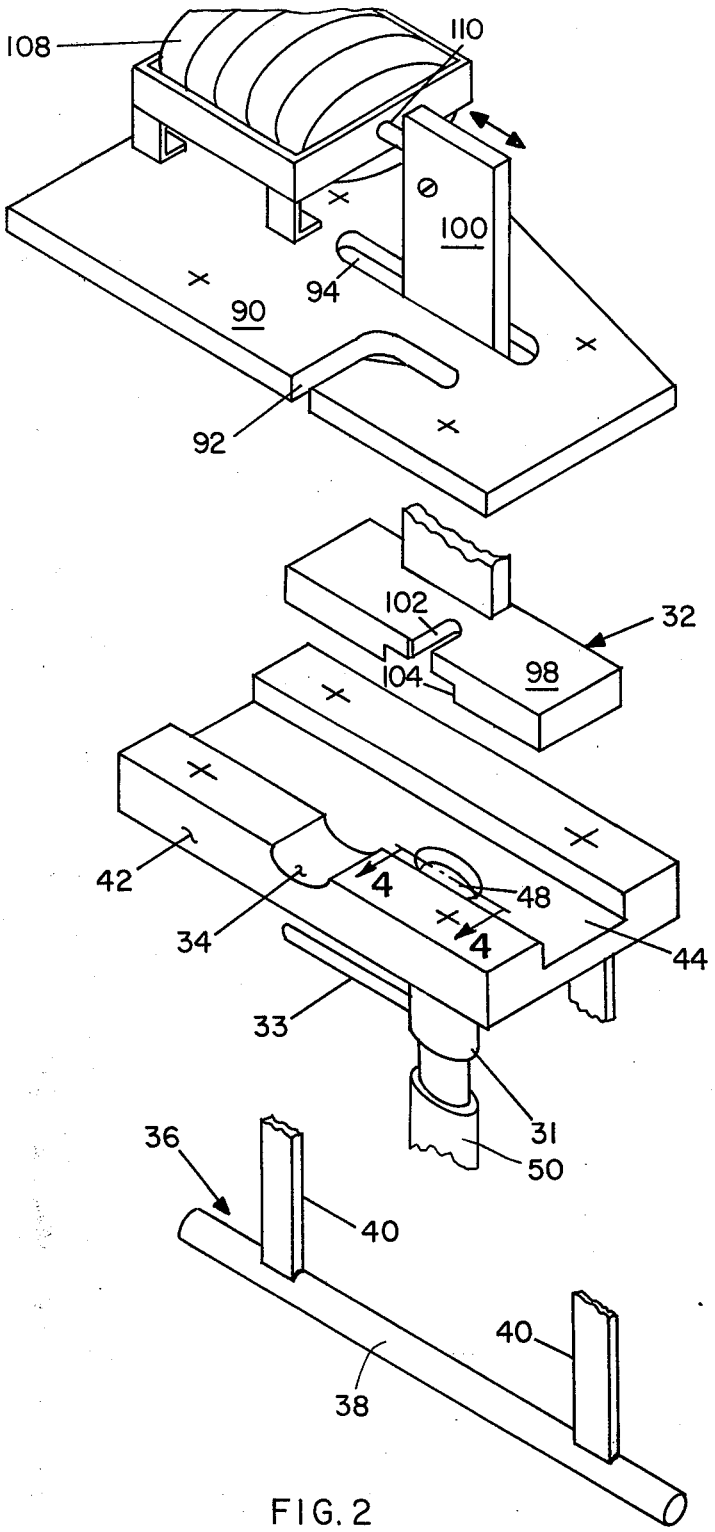
FIG. 2 is an exploded perspective view of the escapement mechanism.
Figure 3:
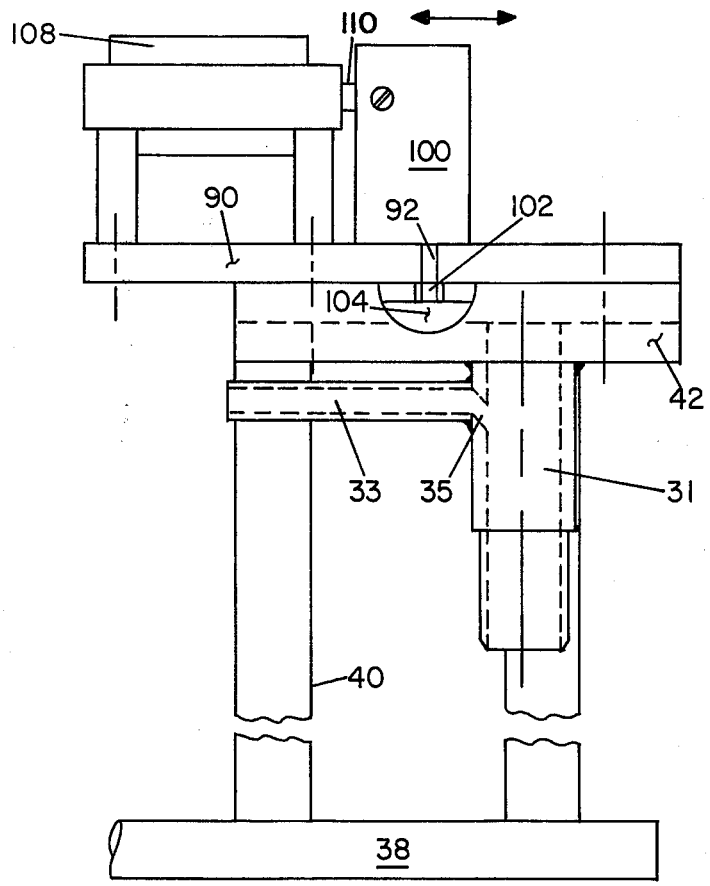
FIG. 3 is a front view of the escapement mechanism illustrated in FIG. 2.
Figure 4:
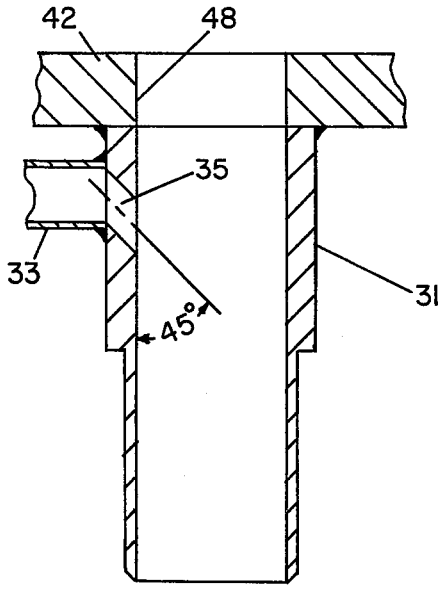
FIG. 4 is a sectional view taken substantially through lines 4—4 of FIG. 2.
Figure 5:
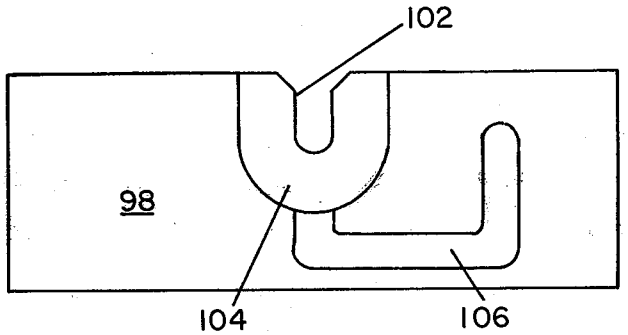
FIG. 5 is a bottom view of the selector slide showing the air groove which connects the inlet and outlet of the escapement mechanism.
Figure 6:
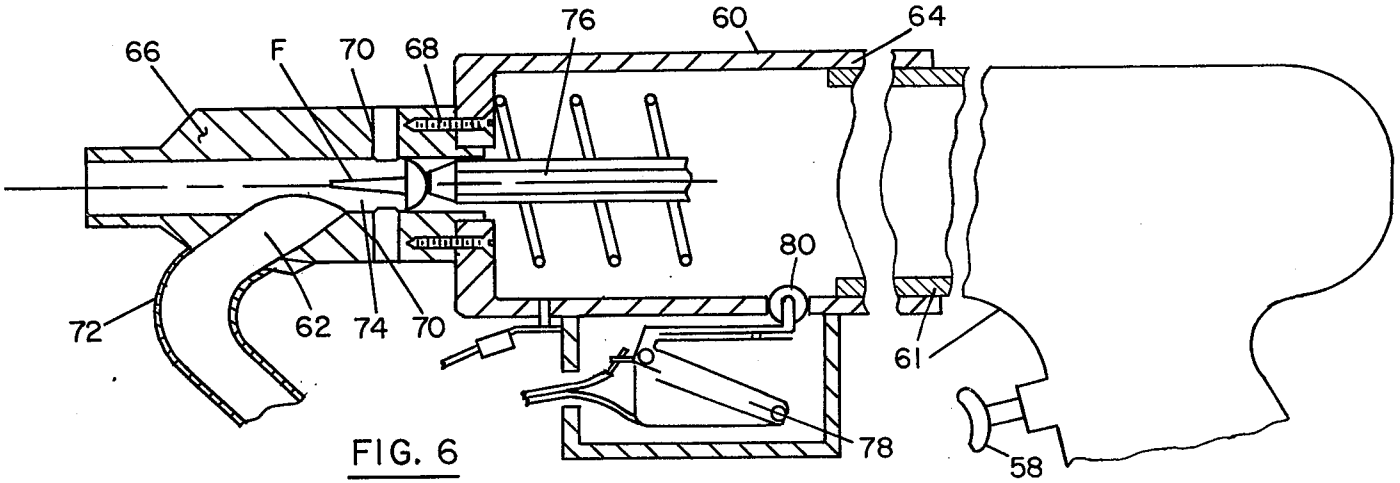
FIG. 6 is an elevation view, partly in section, illustrating the fastener driving mehcanism.

Turning now to a description of a preferred embodiment, and with particular reference to FIG. 1 of the drawings, the apparatus of the present invention includes a supply hopper 10 and an escapement mechanism 30 connected by a delivery means 20 which continuously removes fasteners F from the supply hopper 10 for delivery to the escapement mechanism 30. A pickoff means 32 forms part of the escapement mechanism 30 and is reciprocal between a first position where fasteners are received one at a time at inlet 34 and transferred to a second position at outlet 48 which is in communication with a conduit 50.

An air input means 52 connects a source of compressed air with conduit 50 at a point downstream from the outlet 48 of said escapement mechanism 30 and is selectively operated to direct an air stream through the conduit toward the fastener driving mechanism 60. The downstream air input means 52 creates a negative pressure zone at the outlet 48 of the escapement means 30 causing fasteners to be drawn headfirst by a vacuum from the outlet and into the conduit, whereupon the compressed air blows the fastener headfirst toward the fastener driving mechanism. Conduit 50 is connected at one end to the outlet as aforementioned, and at the other end to the inlet 62 of the fastener driving machine 60.

The fastener driving mechanism 60 is of the type which includes a barrel 64 containing a reciprocal drive piston of the type which may have either a hammer or a screw driver head. A front barrel assembly 66 receives fasteners through an inlet therein, with the opening forming the inlet 62 commencing at a point toward the front of said barrel assembly 66 and slanting inwardly toward the rear of a receiving chamber 74. Conduit 50 connects the front barrel assembly 66 with the automatic feed system set forth hereinabove. The fastener is delivered headfirst into the receiving chamber and rearwardly into engagement with the front end of the drive piston when in its withdrawn position. One or more air outlets 70 extend through the wall of front barrel assembly 66 at a point between the opening and the rear end of receiving chamber 74 to allow air to bleed off while holding the fasteners in proper engagement with the drive piston.

During foward movement of the drive piston the air supply through conduit 50 is cut off when the fastener reaches a prescribed point, so that fasteners are not inadvertently discharged. Otherwise the air supply continuously pushes against the underneath side of the fastener head and holds it against the front end of the drive piston.

Turning now to a more detailed description of the components of the system, the supply hopper 10 is a conventional commercially available virbratory bowl feed, substantially of the type illustrated and described in U.S. Pat. No. 3,160,762. Fasteners are placed in the bowl which includes a conical bottom and a perimetral wall provided with an upwardly extending inclined helical track, wherein as the bowl is vibrated, the fasteners are continuously fed upside down up the helical track to an outlet 16 at the top. The supply hopper is secured at the base thereof to the bottom frame 12 of the feed mechanism housing 14. (The cover of the housing has been removed in FIG. 1 for the sake of clarity).

Delivery means 20 includes an inclined trough 22, which, for tacks and nails, is substantially an inverted T-shaped member having its upper end 24 in communication with the outlet 16 of hopper 10 for receiving fasteners therefrom in a continuous single file arrangement. The lower end 26 of trough 22 is in communication with the inlet 34 of the escapement means 30, as will be further described hereinafter. Although the drawings illustrate nails and tacks being fed along trough 22 in an upside down orientation, screws should, to the contrary, be fed head up, because screws are not easily controlled head down, since the shank is heavier than the head and tends to topple.

Trough 22 must be vibrated so that the fasteners will proceed therealong without hanging up or jamming. Vibration of the trough may be accomplished in one of several ways. The trough 22 may be mechanically connected directly to the bowl portion of the supply hopper as illustrated in FIG. 1. Alternatively, the trough 22 and supply hopper 10 may be attached to the same frame member so that vibrations from the supply hopper pass through the frame member to the trough 22. A third means of connection would be to attach the delivery trough 22 to the base of the supply hopper which contains the vibrating motor. In any event the inclined trough or track 22 vibrates causing the fasteners to move smoothly therealong to the inlet 34 of the escapement means 30.

Turning now to FIGS. 2-5, the escapement means 30 includes a stand 36, which in turn includes a support base 38, mounted in any suitable way to frame 12 or housing 14, and two upstanding posts 40 which support at the upper end thereof a plate 42. Plate 42 includes a central longitudinal groove 44 forming a trough for the reception of the pickoff means 32, and inlet opening 34 is formed through one side wall of plate 42 to provide communication between trough 22 and selector slide 32. An outlet opening 48 extends through the bottom wall of plate 42 at a point longitudinally spaced from the inlet 34 through which fasteners are discharged into conduit 50. It will be seen that fasteners enter the assembly at inlet 34 and leave through outlet 48 as hereinafter described.

A tubular nipple 31 extends downwardly from outlet 48 in plate 42 and provided a means for connecting the flexible conduit 50 with the escapement means 30 as well as providing a means through which a source of air pressure is introduced. A second tubular section 33, transverse to nipple 31 is attached to the side wall of nipple 31 and extends outwardly therefrom to provide a connection for the source of air pressure. An inclined, incoming air port 35 extends through the side wall of the first tubular section 31 at an angle inwardly and downwardly in a direction away from the outlet 48 in the base of the longitudinal groove 44. So arranged, air entering through port 35 moves downwardly away from opening 48 creating a negative pressure or vacuum at that point which tends to draw the fastener headfirst downwardly through nipple 31 into conduit 50. It should also be noted that nipple 31 could extend upwardly from the escape mechanism, as the vacuum would be sufficient to draw the fastener head first upwardly into conduit 50, if desired.

A cover 90 is mounted atop plate 42 in any conventional manner as with screw fasteners which extend downwardly through corresponding holes in cover 90 and plate 42. A longitudinal slot 94 through cover 90 extends parallel to the path of the longitudinal groove 44 in plate 42 for reasons to be hereinafter described. A second, L-shaped slot 92 also extends through cover 90 commencing at a point along the entrance edge of the escape mechanism 30 in registry with inlet 34 and longitudinally from a point inwardly thereof along a line parallel with longitudinal groove 44 at least as far as the outlet opening 48 in plate 42. The L-shaped slot permits fasteners to be moved relative to cover 90 into slide 32 and longitudinally to outlet 48.

The pickoff means 32 comprises a base or slide 98 of approximately the same width and depth as the longitudinal groove 44, so that it may slide back and forth within the groove, and a tongue 100 extending upwardly from base 98 through the longitudinal slot 94 in cover 90. So arranged, slide 98 is reciprocal back and forth between a position for the reception of fasteners through the inlet 34 and a second position for discharging fasteners through outlet 48. The slide 98, as is the case with cover 90 and plate 42 includes a slot 102 extending inwardly through the base 98 for the reception of fastener shanks. An enlarged recess 104 is provided in the underside of plate 98 immediately beneath slot 102 to provide clearnace for the fastener heads as they enter the escapement means.

An air slot 106 extends from the recess 104 to a point spaced therefrom and in the same direction as the outlet 48, so that when pickoff means 32 is in the receiving position for receiving fasteners at inlet 34, the vacuum from outlet 48 is transmitted over to the inlet 34 thereby pulling the fasteners in the inclined track 22 downwardly toward the escapement means. This is a very important feature of the escapement means, because besides preventing blowback of the fasteners up the inclined trough 22 as is the case when a positive pressure exists at the outlet 48, the vacuum or negative pressure encourages proper feeding of the fasteners into the escapement mechanism 30 from the trough 22, thereby facilitating and improving the feeding operation. A solenoid 108 is mounted on cover 90 and the operating piston 110 thereof is operatively connected to the upper end of tongue 100, so that activation of the solenoid causes the slide to reciprocate back and forth within the stationary cover and plate assembly.

Means 30 head up, the upper elements of the escapement mechanism 30 including the plate 42, nipple 31, pickoff means 32, and cover 90 are thereby easily inserted to draw the screws out the top thereof. In such an arrangement, the air supply will feed into nipple 31 at a point above plate 42 and provide such a negative pressure or vacuum as to draw screws out the top of the escapement means 30 overcoming the natural force of gravity.

Conduit 50 is connected at one end thereof to the downwardly extending nipple 31, and at the other end thereof to the fastener driving mechanism 60 as hereinafter described. The fastener driving mechanism 60 includes a conventional main barrel and motor assembly 61, a telescoping barrel portion 64, and into the rear end of the front barrel assembly 66.

An air and fastener inlet 62 extends through the wall of front barrel assembly 66 beginning at a point toward the front end thereof and tapering inwardly and rearwardly into communication with an inner receiving chamber 74. A curved connector member 72 is secured to the front barrel assembly at a point surrounding opening 62 and initiates the curved path of the fasteners into the receiving chamber 74 through inlet 62. As the fastener enters receiving chamber 74 it is urged rearwardly by the air pressure into engagement with the drive piston 76 which in turn is secured to and operated by the main barrel and motor assembly 61. It should be noted that although a screw driver head is shown on the drive piston 76, a hammer like head for driving nails and tacks instead of screws may be used. In such a case, it is preferable to use a substantially flat driving head in which the front end includes an aligning means in the form of a concave area or is magnetic for reasons to be hereinafter discussed.

A plurality of air outlets or vents 70 are provided through the wall of the front barrel assembly 66 at a point between the inlet 62 and the drive piston 76. These air vents allow the air entering the receiving chamber 74 to bleed off, rather than building up and causing turbulance and high pressure. The vents 70 are so positioned as to be approximately aligned with the underside of the head of the fastener when it is up against the drive piston 76. So arranged, the air helps to maintain the fastener against the drive piston 76, and further facilitates alignment of the fastener shank, so that as the drive piston 76 begins its forward movement, the fastener may be driven or screwed straight into the work, rather than at an angle thereto. In the screwdriver type apparatus, the tongue at the front end of the drive piston will engage the slot in the screw head to also help maintain the fastener in proper axial alignment. In the nail or tack driving type apparatus, the combination of the air pressure against the underside of the head along with the aligning means at the front end of the plunder 76 head will keep the nail or tack shank properly aligned.

It should be noted in this regard that in the magnetic tack hammers, decorative (round headed) nails or tacks that have a round brass head with a steel shank may be used as well as flat head tacks, and the magnetic front end of the drive system will attract the steel shank to properly orient the tack within the receiving chamber.

As the drive piston 76 begins its forward movement, it is necessary to cut off the air supply at some point as hereinabove mentioned. Otherwise, as the fastener head moves past the inlet 62, the air pressure may inadvertently blow the fastener out the front end of the fastener driving mechanism before it is in engagement with the work piece. Toward this end, a microswitch assembly 78 is attached to the telescoping barrel portion 64 and includes a trip 80 extending through the barrel wall into the path of the main barrel. Microswitch assembly 78 is electrically connected by means of electrical line 110 to solenoid 108 for the operation thereof, and is electrically connected to a valve (not shown) in air supply line 52 for turning on and off the air supply to the escapement mechanism as described hereinafter.

As the telescoping portion of the barrel moves relative to the main portion of the barrel, as when the operator places the front barrel assembly 66 into engagement with the work piece and provides a slight pressure thereagainst, the main barrel slides within the telescoping portion 64. The switch trip 80 is so positioned that movement of the barrel 60 through a distance necessary to reach trip 80 is equal to the distance necessary to move the fastener F in the receiving chamber forward sufficiently to clear the air inlet 62. The microswitch 78 is then closed which in turn shuts off the air supply 52 until the fastener has been driven into the work piece and the main assembly 61 returns past and releases switch trip 80. Release of switch trip 80 also activates solenoid 108 to move another fastener through the escape mechanism.

In operation fasteners F are deposited in the supply hopper 10, and when the operator is ready to commence use of the apparatus, the vibrating motor of the supply hopper 10 is turned on causing the fasteners to work their way up the inclined helical track around the hopper to the outlet 16 thereof. The fasteners then proceed in single file into the inclined trough 22 of the delivery means 20, which is also vibrating, whereupon the fasteners travel down the trough to the entrance of the escapement means 30.

The reciprocating selector slide 96, which is operated by the solenoid 108 in response to release of switch trip 80, moves from a first or receiving position where the receiving slot 102 thereof is aligned with inlet 34 of plate 42 and slot 92 of the cover 90. As the slide moves to its second or discharge position, it carries with it a single fastener F to a point where the fastener (tacks or nails in the illustrated case) is positioned over the outlet 48 in the bottom of longitudinal groove 44. The vacuum or negative air pressure draws the fastener out of the slide 96 and into conduit 50, where it is carried on to the fastener driving mechanism. The negative air pressure or vacuum is produced by means of the air supply which enters the first tubular section 31 or the conduit 50 through an inclined air port 35 which directs the air in a direction away from outlet 48. As the slide 96 returns to its receiving position, the air slot 106 in the bottom side of the base 98 of the slide provides communication between the negative air pressure at the outlet and the delivery means 20 which always urges the fasteners down the inclined trough 22 into the escapement means 30, thereby facilitating the feeding operation.

As the fastener proceeds through conduit 50 in a headfirst direction, another fastener has already entered receiving chamber. After the preceding fastener is implaced, reactivation of the air supply 52 blows the subject fastener headfirst rearwardly into the receiving chamber 68 and a second fastener enters conduit 50. The continuous air pressure against the underside of the head maintains the fastener in engagement with the front end of the drive piston (which may be either a screw driver head or tack hammer head). The air is continuously bled off through air vents 70 provided through the wall of the front barrel assembly at a point between the inlet and the drive piston. As the trigger 58 is pulled drive piston 76 moves forwardly and the main barrel assembly 61 engages switch trip 80 of microswitch 78 which cuts off the air supply through conduit 50, so that the fastener is not inadvertently blown out the front end of the front barrel assembly 66 as the head of the fastener passes the inlet 62. A third fastener is picked off from the delivery means 20 when the drive piston 76 of the fastener driving mechanism 60 return to its withdrawn position and releases switch trip 80, as the second fastener enters the receiving chamber 74.

Various modifications of the above described embodiment of the invention will become apparent to those skilled in the art, such as those necessary to drive screws or rivets. It is understood that such modifications can be made without daparting from the scope of the invention, which is set forth in the following claims:

What is claimed is:

1. A pneumatic fastener driving mechanism and continuous fastener supply mechanism therefore comprising in combination:

a. supply hopper and delivery means for continuously removing fasteners from said supply hopper;

b. escapement means having an inlet adjacent said delivery means and an outlet, said escapement means including a pickoff means for receiving fasteners at said inlet and delivering them one at a time to said outlet;

c. a fastener conduit connected at one end to said outlet and at the other end to said fastener driving mechanism, said conduit selectively receiving fasteners headfirst from said escapement means for delivery to said fastener driving mechanism;

d. air input means connected to said conduit at a point downstream from said outlet of said escapement means, said air input means selectively directing an air stream toward said fastener driving mechanism and establishing a negative air pressure at the outlet of said escapement means, whereby fasteners are urged by vacuum from said outlet into said conduit without an attendant blowback of fasteners in said delivery means;

e. said automatic fastener driving mechanism including a barrel containing a reciprocal drive piston, said barrel means further including a front barrel assembly attached to the front end of said barrel assembly and including a longitudinally extending receiving chamber;

f. said front barrel assembly further including a fastener inlet through the wall thereof, said inlet commencing at a point near the front of said barrel assembly and being slanted inwardly toward the rear of said receiving chamber;

g. means for connecting said inlet with said conduit;

h. at least one air vent extending through said barrel assembly at a point between said fastener inlet and a rear end of said receiving chamber;

i. whereby fasteners are fed by air pressure head first through said opening and into contact with the front end of said piston when in its withdrawn position, said air pressure escaping through said vent and holding said fastener in proper engagement with said drive piston within said receiving chamber.

2. The apparatus according to claim 1 and further including a switch means cooperatively connected with said barrel assembly for activation in response to a forward movement of said fastener in said receiving chamber, said air input means being selectively deactivated in response to activation of said switch means and said escapement means being activated in response to a deactivation of said switch means.

* * * * *